US006054699A

United States Patent [19]

Kim et al.

[11] Patent Number: 6,054,699

[45] Date of Patent: Apr. 25, 2000

[54] FRONT PANEL ASSEMBLY FOR MICROWAVE OVEN AND METHOD FOR ASSEMBLING THE SAME

[75] Inventors: Byeong-Jun Kim; Byung-Nam Choi; Sang-Kee Min, all of Incheon, Rep. of Korea

[73] Assignee: Daewoo Electronics Co., Ltd., Seoul, Rep. of Korea

[21] Appl. No.: 09/169,949

[22] Filed: Oct. 13, 1998

[51] Int. Cl.[7] ..... H05B 6/64

[52] U.S. Cl. ..... 219/756; 219/702; 219/739

[58] Field of Search ..... 219/756, 720, 219/702, 506, 739

[56] References Cited

U.S. PATENT DOCUMENTS

| | | | |
|---|---|---|---|
| 3,789,823 | 2/1974 | Doskocil . | |
| 4,336,569 | 6/1982 | Tsuda et al. . | |
| 4,575,601 | 3/1986 | Taguchi et al. | 219/702 |
| 5,473,807 | 12/1995 | Tupa et al. . | |
| 5,731,571 | 3/1998 | Park | 219/720 |

FOREIGN PATENT DOCUMENTS

| | | | |
|---|---|---|---|
| 0 781 073 | 6/1997 | European Pat. Off. . | |
| 1-318817 | 12/1989 | Japan | 219/720 |
| 2-68880 | 3/1990 | Japan | 219/720 |
| 1 568 705 | 6/1980 | United Kingdom . | |
| 2 099 988 | 12/1982 | United Kingdom . | |
| 2 255 397 | 11/1992 | United Kingdom | 219/720 |

OTHER PUBLICATIONS

JP 10134954 A, (Sanyo) see online abstract (WPI) and the figure for protective covering 106, Accession No. 98–353280.

*Primary Examiner*—Philip H. Leung
*Attorney, Agent, or Firm*—Pillsbury Madison & Sutro LLP

[57] ABSTRACT

A front panel assembly of a microwave oven which can improve the appearance and strength of the oven and a method for assembling the same are disclosed. The assembly includes a front panel frame and a reinforcement plate attached to the front panel frame and made of a metal such as stainless steel or synthetic resin. The assembly is assembled to a door frame or a front panel section of the oven. The front panel frame is formed with a recess into which the reinforcement plate is attached. The reinforcement plate is attached to the recess by using a double-sided adhesive tape or by a heat-treatment. The welding lines and non-homogeneous colors formed at the door frame and the front panel frame can be hidden and the strength of the oven increases.

8 Claims, 6 Drawing Sheets

FRONT PANEL ASSEMBLY FOR MICROWAVE OVEN AND METHOD FOR ASSEMBLING THE SAME

BACKGROUND OF THE INVENTION

1. Field of the Invention

The present invention relates to a front panel assembly of a microwave oven, and more particularly to a front panel assembly of a microwave oven and a method for assembling the front panel assembly to the oven, which can cover a door frame and a front panel frame and hide welding lines and an uneven color formed at the surface of the door frame and the front panel frame formed when they are injection-molded, thereby improving the appearance of the microwave oven and also reinforcing the front portion of the microwave oven.

2. Description of the Prior Art

Generally, in a conventional microwave oven as shown in FIG. 1, a door 10 having a door frame 12 and a door screen 14 is coupled to a front portion of a heating chamber so as to allow the user to open and/or close the heating chamber. In addition, a front panel 20 provided with buttons for selecting various functions of the microwave oven is assembled to a front portion of a control chamber, adjacent to the heating chamber, in which a printed circuit board (PCB) electrically connected to the buttons is installed.

Since door 10 and front panel 20 is readily seen in front of the microwave oven, every manufacturers, for the merits of appearance, makes door frame 12 and front panel 20 which are injection-molded from synthetic resin having various colors. However, door frame 12 and front panel 20 have welding lines that appear in joining portions along which injected fluids spread out and then meet together while being injection-molded from synthetic resin. The welding lines do not apparently appear when the injected fluid has bright colors such as light-yellow and white, but the welding lines apparently appear when the injected fluid has original colors such as red, yellow, blue or black. Also, uneven color is formed from a density difference of the synthetic resin while being injection-molded, so the appearance becomes worse and various restrictions in selecting the synthetic resin arise. The welding lines which appear on front surfaces of the conventional door frame 12 and front panel 20 influences on the appearance of the microwave oven. That is, the appearance of the microwave oven becomes worse. As the result, the microwave oven does not appeal to consumers.

Since the conventional injection-molded door frame 12 and front panel 20 have relatively low surface rigidity and strength, there may be formed scratches at the surfaces thereof, so the appearance of the microwave oven is not fine. In addition, door frame 12 and front panel 20 are often cracked by an external impact in use or a falling test.

SUMMARY OF THE INVENTION

The present invention is intended to overcome the above-described disadvantages. Therefore, it is an object of the present invention to provide a front panel assembly in which particularly shaped reinforcement plate made of metal or synthetic resin can be attached or covered over the front surface of the door frame or the front panel frame so as to hide the welding lines and non-homogeneous colors and further to increase the strength of the microwave oven against impact even when the door or the front panel frame is made of a relatively pliable material.

In order to achieve the above object of the present invention, there is provided a method for assembling a front panel assembly to a microwave oven. The method comprises the steps of:

(1) forming a recess having a predetermined depth at a front surface of a front panel frame; (2) coupling the front panel frame to a predetermined portion of a front surface of the microwave oven; (3) manufacturing a reinforcement plate made of an opaque material and identical to the recess of the front panel frame in size; and (4) bring the reinforcement plate into contact with the recess of the front panel frame and applying a pressure on a front surface of the reinforcement plate such that the reinforcement plate is fixedly attached to the front panel frame.

According to one embodiment of the present invention, the step (3) comprises the substeps of: press-machining a raw material made of stainless steel or synthetic resin in such a manner that the raw material has a size and a thickness identical to a size and a depth of the recess; and printing characters and ornamental designs for indicating various functions of the door section of and the front panel section of the microwave oven onto a front surface of the reinforcement plate by a heat-treatment.

According to another embodiment, the step (3) comprises the substeps of: coloring a raw material made of stainless steel or synthetic resin; press-machining the raw material to be substantially identical to the recess of the front panel frame in size and to have a depth identical to a depth of the recess; and printing characters and ornamental designs for indicating functions of a door section or a front panel section, to which the front panel frame is to be assembled, onto a front surface of the machined raw material by a heat-treatment.

According to one embodiment, the step (4) comprises the substeps of: machining a double-sided adhesive tape to be identical to the reinforcement plate in shape; attaching the double-sided adhesive tape to a rear surface of the reinforcement plate and pressing the reinforcement plate into the recess of the front panel frame.

According to another embodiment, in step (4), in a case that the reinforcement plate is made of a metal such as a stainless steel, about 1 to about 50 $kg_f/mm^2$ of pressure is applied to the front surface of the reinforcement plate and about 100 to about 350° C. of heat is applied to the front panel frame so as to melt an attaching surface of the front panel frame, and in a case that the reinforcement plate is made of the synthetic resin, about 1 to about 30 $kg_f/mm^2$ of pressure is applied to the front surface of the reinforcement plate and about 100 to about 350° C. of heat is applied to the front panel frame.

On the other hand, a front panel assembly of a microwave oven comprises: a front panel frame assembled to the microwave oven, the front panel frame being injection-molded; a reinforcement plate attached to the front panel frame for hiding a portion of the front panel frame and protecting a door section or a front panel section of the microwave oven, over which the front panel frame is to be assembled, the reinforcement plate being press-machined; and a double-sided adhesive tape for attaching the reinforcement plate to the front panel frame.

BRIEF DESCRIPTION OF THE DRAWINGS

The above object and other advantages of the present invention will become more apparent by describing in detail preferred embodiments thereof with reference to the attached drawings in which.

DETAILED DESCRIPTION OF THE INVENTION

Hereinafter, various embodiments of the present invention will be explained in more detail with reference to the accompanying figures.

Figure 1:
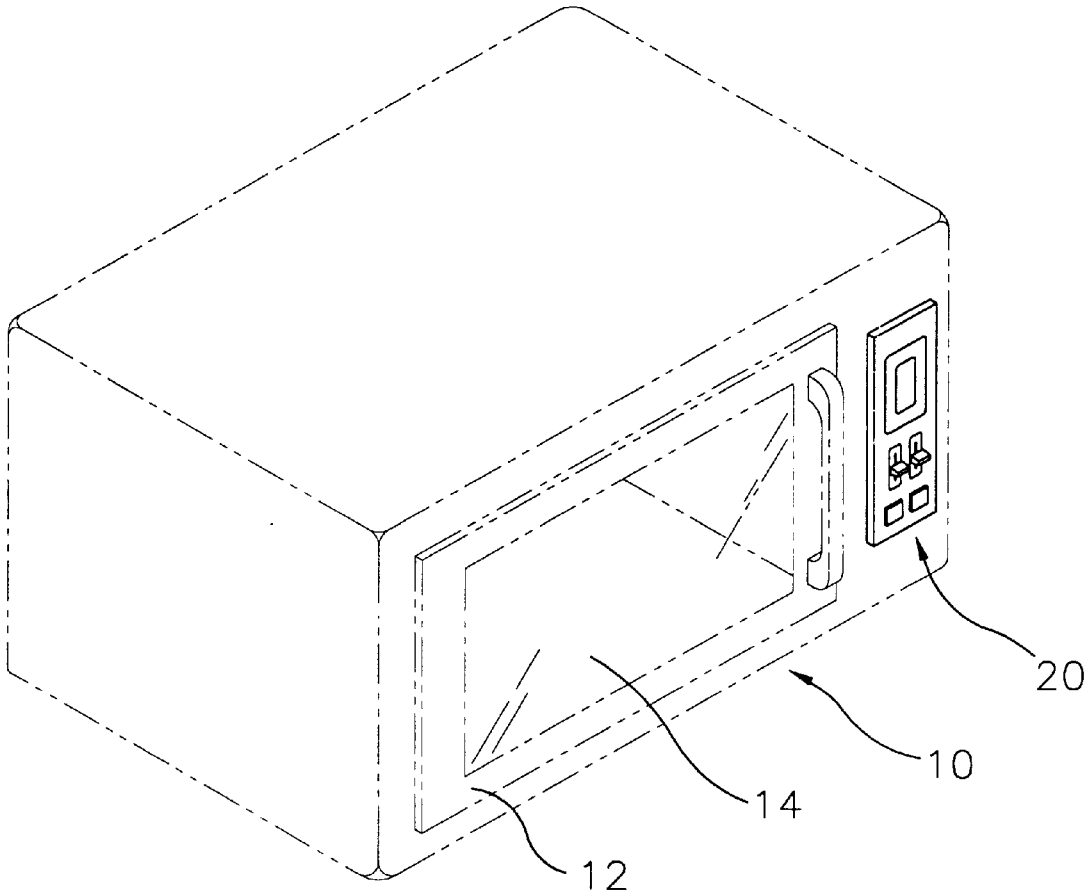
FIG. 1 (PRIOR ART)
FIG. 1 is a perspective view for showing a front panel of the conventional microwave oven.
Figure 2:
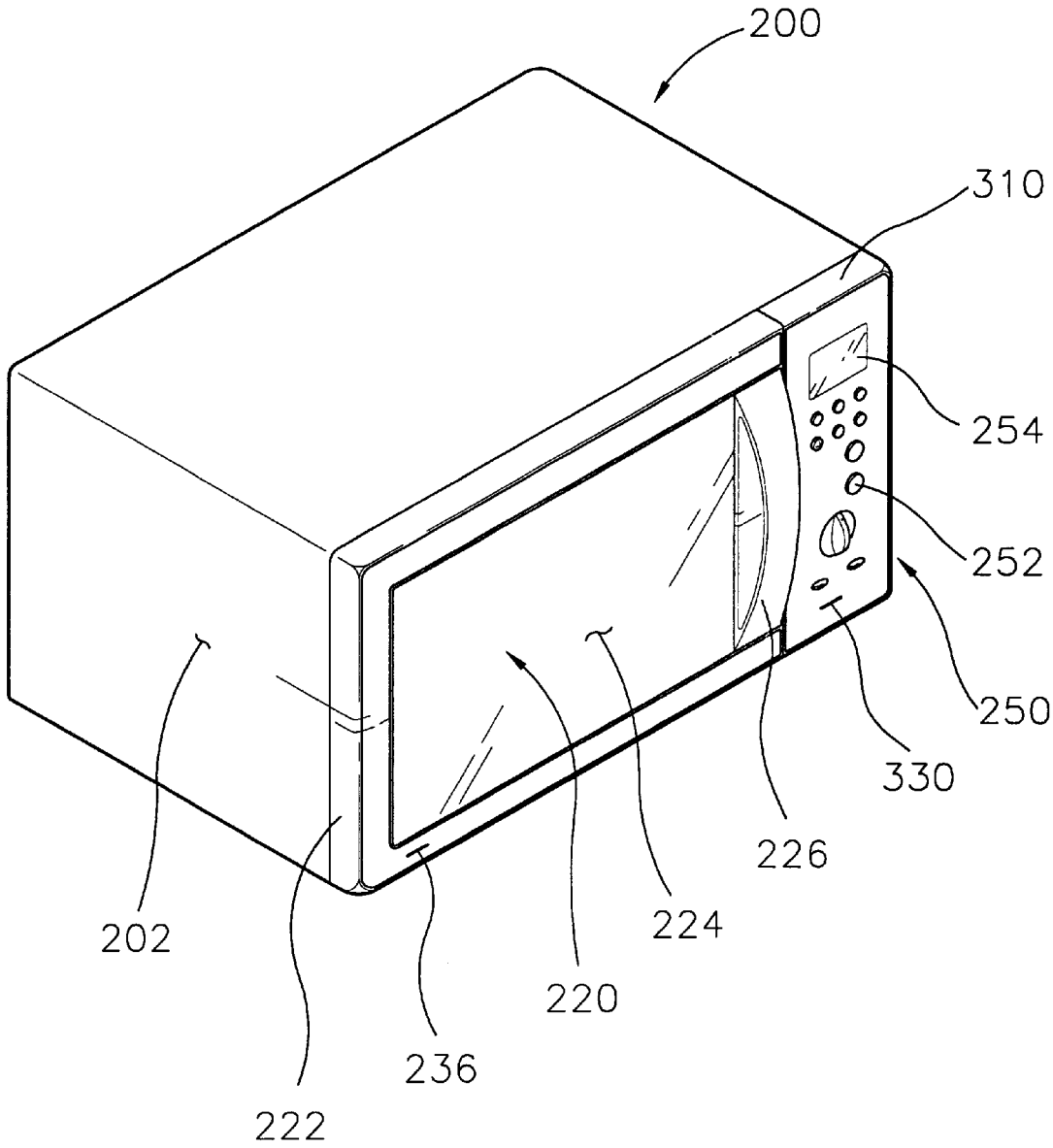
FIG. 2 is a perspective view for showing a microwave oven according to one embodiment of the present invention.

Referring to FIG. 2, a door section 220 and a front panel section 250 are coupled to a front portion of a microwave oven 200. Door section 220 is pivotably hinged to a side wall 202 of microwave oven 200 so as to allow the user to put in or take out foods in/from microwave oven 200. Door section 220 includes a window type door frame 222, a door screen 224 which is disposed in door frame 222 for showing the interior of a heating chamber while the foods are cooked, and a knob portion 226 positioned on door frame 222 in opposition to side wall 202 for opening or closing door section 220.

Front panel section 250 having a plurality of buttons 252 and a display portion 245 is disposed in a side part of door section 220. A printed circuit board (not shown) for controlling various functions such as cooking time is disposed inside of front panel section 250. Front panel frame 310 which is substantially identical to front panel section 250 in shape, is disposed on a front surface of front panel section 250 to protect the button 252 and the printed circuit board.

Generally, door frame 222 and front panel frame 310 are injection-molded from synthetic resin and accordingly, there are formed welding lines along joining portions, at which projected fluids are met after spread from each other, when holes for permitting various control buttons to pass therethrough are formed particularly at front panel frame 310. The welding line can be covered by a front panel assembly of the present invention.

Figure 3:
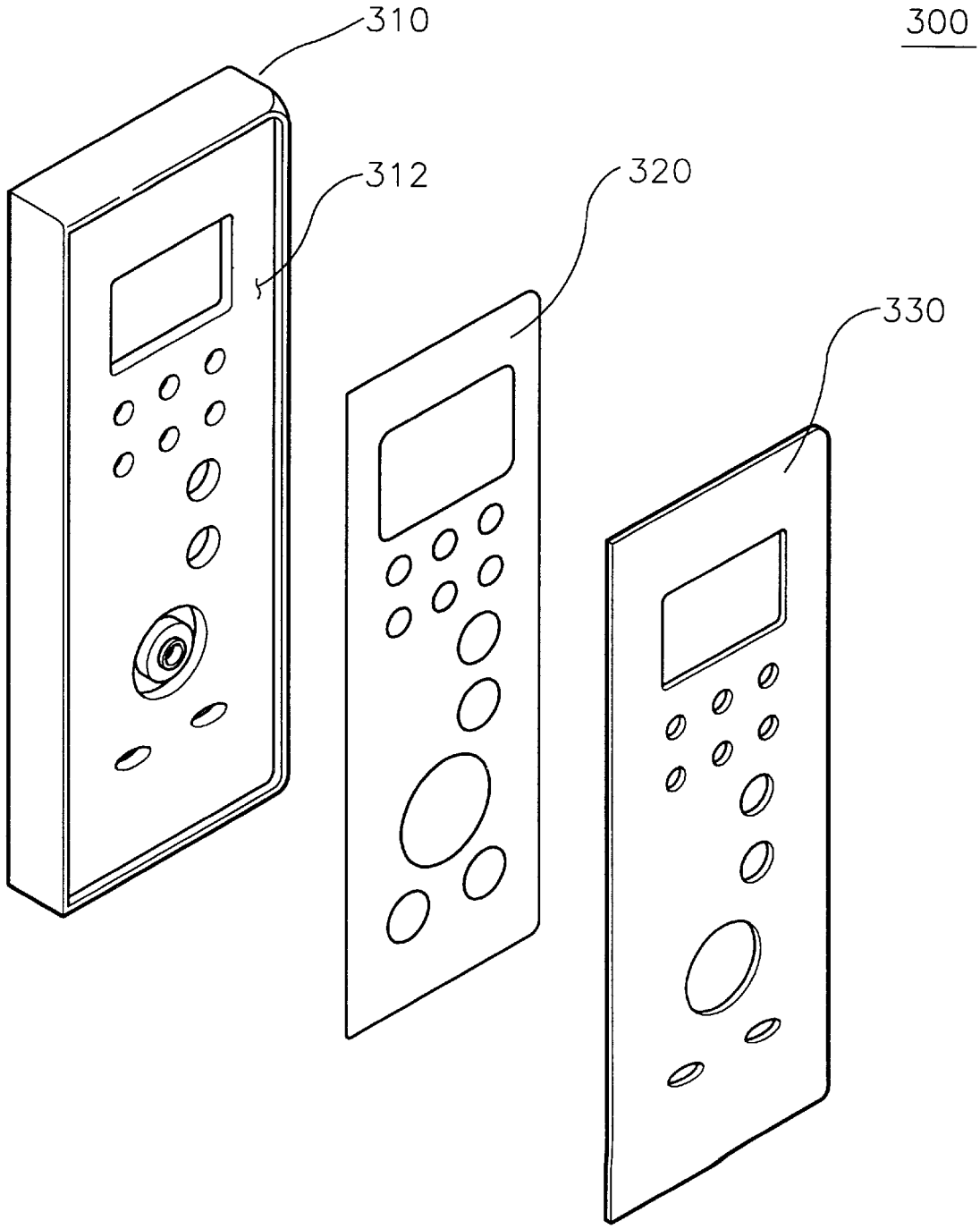
FIG. 3 is an exploded perspective view of a front panel assembly in FIG. 2.

As illustrated in FIG. 3, front panel assembly 300 according to one embodiment of the present invention includes a front panel frame 310 assembled to the microwave oven 200, a reinforcement plate 330 attached to front panel frame 310 for covering the external surface of front panel frame 310 and formed by press-machining for protecting door section 220 and front panel section 250 of microwave oven 200 against an external impact, and a double-sided adhesive tape 320 for assembling front panel frame 310 with reinforcement plate 330.

Front panel frame 310 is formed with a recess 312 having a predetermined shape. Preferably, recess 312 has an identical shape to front panel frame 310 so as to maximize the area of recess 312. Reinforcement plate 330 is made of a metal such as stainless steel or synthetic resin and is manufactured by press-machining such that reinforcement plate 330 has a size and a thickness substantially identical to the size and the depth of recess 312. In order to assemble reinforcement plate 330 into front panel frame 310, double-sided adhesive tape 320 is firstly attached to a rear surface of reinforcement plate 330. Then, reinforcement plate 330 with double-sided adhesive tape 320 is press-fitted into recess 312.

Figure 4:
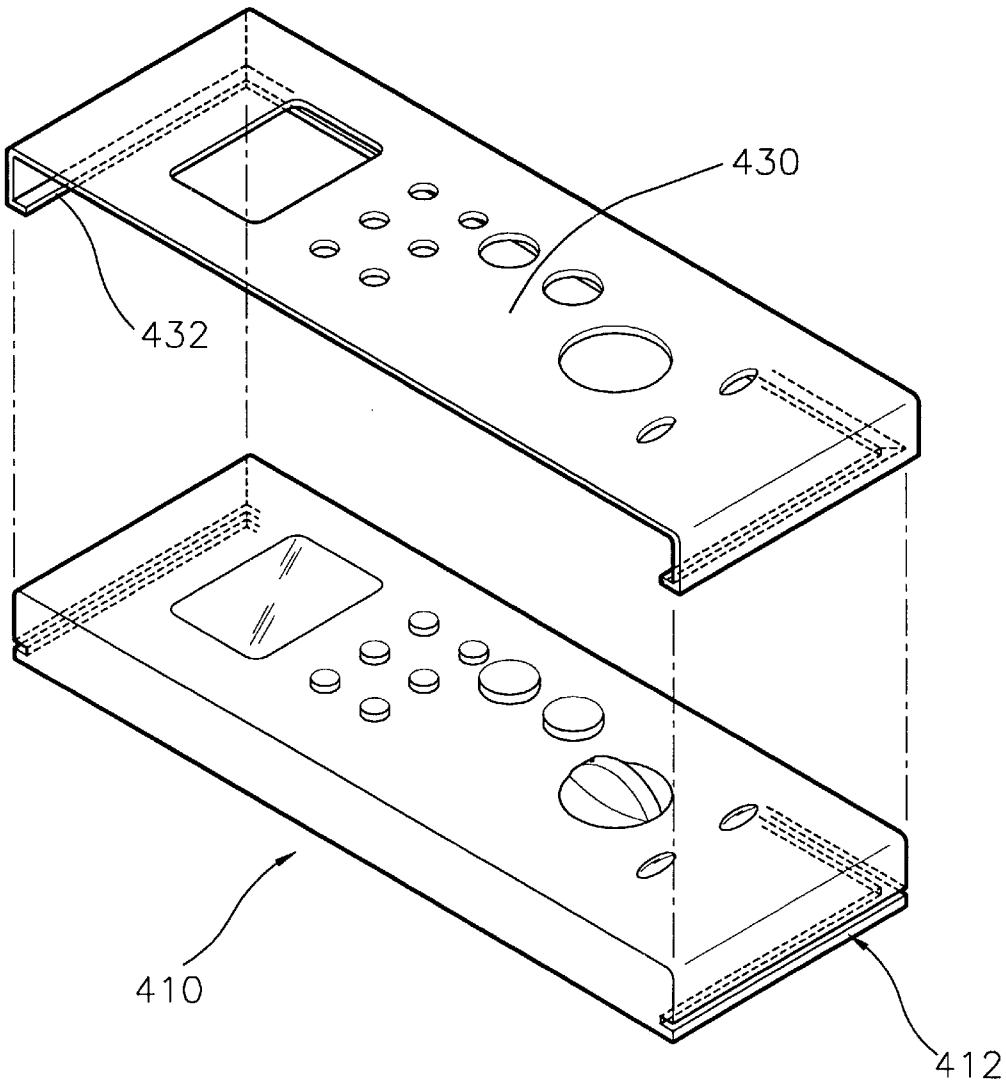
FIG. 4 is an exploded perspective view of a front panel assembly according to the other embodiment.

A joined structure of a front panel frame 410 and a reinforcement plate 430 according to another embodiment of the present invention is illustrated in FIG. 4. The reinforcement plate 430 is press-machined from a metal such as stainless steel or synthetic resin and is manufactured to have a size corresponding to a size of front panel frame 310. Grooves 412 are respectively formed at upper and lower surfaces of front panel frame 310. Latches 432 are formed at portions of reinforcement plate 430 corresponding to grooves 412 of front panel frame 310. Preferably, latches 432 are inserted in and then is adhered to grooves 412 while being assembled.

Onto the front surface of reinforcement plate 330, characters and ornamental designs for indicating various functions of door section 220 and front panel section 250 are printed by heat-treatment, together with predetermined colors.

Figure 5:
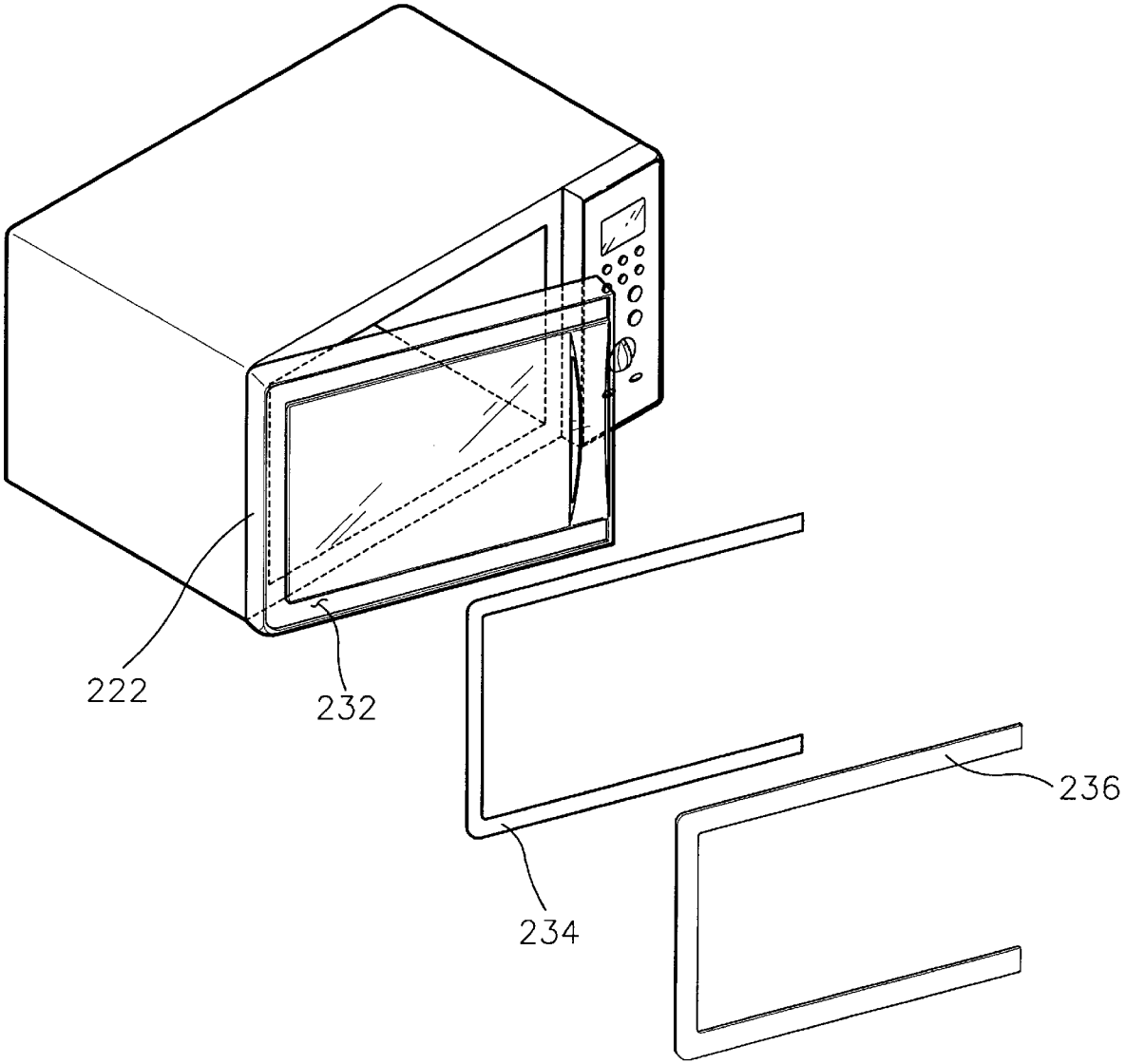
FIG. 5 is an exploded perspective view showing a case that a reinforcement plate is attached to a door frame of the microwave oven.

On the other hand, as illustrated in FIG. 5, when the worker attaches reinforcement plate 330 to door section 220, after forming a recess 232 along an outer periphery portion of door frame 222, double-sided adhesive tape 234 is attached into recess 232, and reinforcement plate 236 having an identical shape to the shape of recess 232 is attached to double-sided adhesive tape 234.

Figure 6:
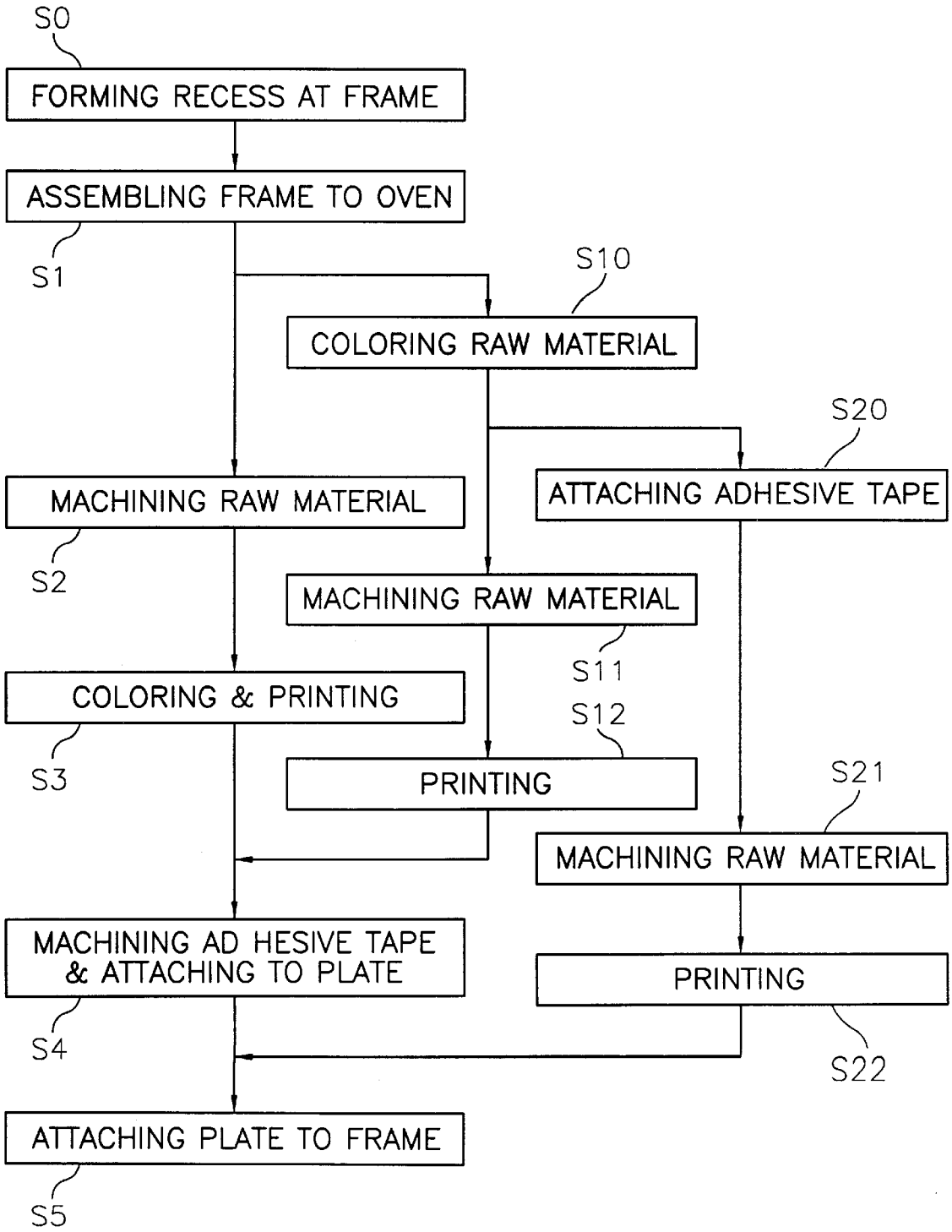
FIG. 6 is a flow chart for explaining a method for assembling the front panel assembly.

Hereinafter, the method for assembling the front panel assembly into microwave oven 200 according to embodiments of the present invention will be described in detail with reference to FIG. 6.

Firstly, a recess 312 having a predetermined depth is formed at a front surface of front panel frame 310 (step S0). After that, front panel frame 310 is joined to door section 220 or front panel section 250 of microwave oven 200 (step S1). Next, a reinforcement plate 330 having a size corresponding to a size of recess 312 of front panel frame 310 and made of opaque material is manufactured. The reinforcement plate 330 manufacturing step includes the substeps of press-machining a raw material made of a metal such as stainless steel or synthetic resin such that the raw material has a size corresponding to a size of recess 312 and a thickness of the raw material is approximately equivalent to a depth of recess 312 (step S2), and printing characters and ornamental designs of desired colors are printed on a front surface of the raw material by heat-treatment (step S3). Reinforcement plate 330 is coupled to door section 220 or front panel section 250 of microwave oven 220. The characters and ornamental designs indicate functions of door section 220 and front panel section 250.

Thereafter, double-sided adhesive tape 320 is machined to be identical to reinforcement plate 330 in shape and is then attached to a rear side of reinforcement plate 330 (step S4). Finally, reinforcement plate 330 is placed in recess 312 of front panel frame 310 and is pressed so as to be fixedly attached to front panel frame 310 (step S5).

According to another embodiment, a method for attaching reinforcement plate 330 to front panel frame 310 by heat-treatment without using the double-sided adhesive tape is proposed.

Preferably, in case that reinforcement plate 330 is a metal such as stainless steel, a pressure of about 1 to about 50 $Kg_f/mm^2$ is applied to front panel frame 310 with heat of about 100 to about 350° C. so as to melt an attaching portion of front panel frame 310. In case of synthetic resins, a pressure of about 1 to about 30 $Kg_f/mm^2$ is applied to front panel frame 310 with heat of about 100 to about 350° C.

According to one embodiment, the method of manufacturing the reinforcement plate 330 has the steps of coloring a raw material made of the metal such as stainless steel or synthetic resin (step S10), press molding the raw material such that the raw material has a thickness and a size substantially identical to a depth and a size of recess 312 of front panel frame 310, respectively (step S11), and printing characters or ornamental designs indicating functions of microwave oven 200 on a front surface of the raw material by applying a heat (step S12).

According to another embodiment, there is a method in which the raw material and the double-sided adhesive tape adhere to each others and then are manufactured to have a shape identical to the shape of front panel frame 310. In this embodiment, firstly, the raw material made of stainless steel or synthetic resin plate is colored with a desired color, and then the double-sided adhesive tape adheres to a rear surface of the raw material. Next, the raw material is machined to provide a reinforcement plate. Characters and ornamental designs are printed on a front surface of reinforcement plate 330 by heat-treatment.

As described above, the particularly shaped reinforcement plate made of a metal such as stainless steel or synthetic resin can be attached or covered over the front surface of the door frame or the front panel frame so as to hide the welding lines and non-homogeneous colors and further to increase the strength of the microwave oven against impact even when the door or the front panel frame is made of a relatively pliable material.

As described above, in the method for assembling of the front panel assembly, since the double-sided adhesive tape is machined to have the identical shape to the shape of the reinforcement plate, an attaching surface thereof becomes a maximum. On the other hand, in case that the double-sided adhesive tape is not used, the reinforcement plate is attached by heat-pressing. Furthermore, by using the double-sided adhesive tape and the heat-pressing together, the adhesive strength of the double-sided adhesive tape increases up to a maximum, thereby fixedly attaching the reinforcement plate to the microwave oven. The user can select any one method among above methods according to the shape of the assembling portions of the front panel assembly and the material of the reinforcement plate, thereby effectively carrying out the assembling work.

Although the preferred embodiments of the invention have been described, it is understood that the present invention should not be limited to these preferred embodiments, but various changes and modifications can be made by one skilled in the art within the spirit and scope of the invention as hereinafter claimed.

What is claimed is:

1. A method for assembling a front panel assembly to a microwave oven, the method comprising the steps of:

(1) forming a recess having a predetermined depth at a front surface of a front panel frame;

(2) coupling the front panel frame to a predetermined portion of a front surface of the microwave oven;

(3) manufacturing a reinforcement plate made of an opaque material and identical to the recess of the front panel in size:

(4) bringing the reinforcement plate into contact with the recess of the front panel frame and applying a pressure on a front surface of the reinforcement plate such that the reinforcement plate is fixedly attached to the front panel frame;

(5) matching a double-sided adhesive tape to be identical to the reinforcement plate in shape; and (6) attaching the double-sided adhesive tape to a rear surface of the reinforcement plate and pressing the reinforcement plate into the recess of the front panel frame.

2. The method as recited in claim 1, wherein the step (3) comprises the substeps of:

press-machining a raw material made of stainless steel or synthetic resin in such a manner that the raw material has a size and a thickness identical to a size and a depth of the recess, respectively; and printing characters and ornamental designs for indicating various functions of the door section of and the front panel section of the microwave oven onto a front surface of the reinforcement plate by a heat-treatment.

3. The method as recited in claim 1, wherein the step (3) comprises the substeps of:

coloring a raw material made of a stainless steel or a synthetic resin;

press-machining the raw material to be substantially identical to the recess of the front panel frame in size and to have a depth identical to a depth of the recess; and printing characters and ornamental designs for indicating functions of a door section or a front panel section, to which the front panel frame is to be assembled, onto a front surface of the machined raw material by a heat-treatment.

4. The method as recited in claim 1, wherein in step (4), in a case that the reinforcement plate is made of the stainless steel, a pressure of about 1 to about 50 $kg_f/mm^2$ is applied to the front surface of the reinforcement plate and a heat of about 100 to about 350° C. is applied to the front panel frame so as to melt an attaching surface of the front panel frame, or in a case that the reinforcement plate is made of the synthetic resin, a pressure of about 1 to about 30 $kg_f/mm^2$ is applied to the front surface of the reinforcement plate and a heat of about 100 to about 350° C. is applied to the front panel frame.

5. A method for assembling a front panel assembly to a microwave oven comprising the steps of:

forming a recess having a predetermined depth at a front surface of a front panel frame;

coupling the front panel frame to a door section or to a front panel section of the microwave oven;

coloring a raw material made of a stainless steel or a synthetic resin;

attaching a double-sided adhesive tape to a rear surface of the colored raw material;

press-machining the raw material in such a manner that the raw material is substantially identical to the recess of the front panel frame in size and has a thickness identical to a depth of the recess, thereby providing a reinforcement plate;

printing characters and ornamental designs for indicating functions of a door section or a front panel section, to which the front panel frame is to be assembled, onto a front surface of the reinforcement plate by a heat-treatment; and bringing the reinforcement plate into contact with the recess of the front panel frame and applying a pressure and a heat on a front surface of the reinforcement plate so as to fixedly attach the reinforcement plate to the front panel frame.

6. A front panel assembly of a microwave oven, the assembly comprising:

a front panel frame assembled to the microwave oven, the front panel frame being injection-molded;

a reinforcement plate attached to the front panel frame for hiding a portion of the front panel frame and protecting at least one of a door section and a front panel section of the microwave oven, over which the front panel frame is to be assembled, the reinforcement plate being press-machined; and a double-sided adhesive tape attaching the reinforcement plate to the front panel frame, wherein the front panel frame is formed with a recess having a predetermined shape, the reinforcement plate is manufactured by press-molding a raw material made of a stainless steel or a synthetic resin such that the raw material has a size and a thickness identical to a size and a depth of the recess, respectively, the double-sided adhesive tape is interposed between the reinforcement plate and the recess, and the reinforcement plate is press-fitted into the recess.

7. The assembly as recited in claim 6, wherein characters and ornamental designs for indicating various functions of the door section and the front panel section are printed on a front surface of the reinforcement plate by a heat-treatment.

8. A front panel assembly of a microwave oven, the assembly comprising:

a front panel frame assembled to the microwave oven, the front panel frame being injection-molded;

a reinforcement plate attached to the front panel frame for hiding a portion of the front panel frame and protecting at least one of a door section and a front panel section of the microwave oven, over which the front panel frame is to be assembled, the reinforcement plate being press-machined; and a double-sided adhesive tape for attaching the reinforcement plate to the front panel frame, wherein the reinforcement plate is manufactured by press molding a raw material made of a stainless steel and a synthetic resin such that the raw material is identical to the front panel frame in size, the front panel frame is formed at upper and lower surfaces thereof with grooves, the reinforcement plate is formed at portions thereof corresponding to the grooves with latches, and while the reinforcement plate is assembled into the front panel frame, the latches are press-fitted into the grooves, and the double-sided adhesive tape is interposed between the grooves and the latches.

* * * * *